US009289644B2

(12) United States Patent
Carson

(10) Patent No.: US 9,289,644 B2
(45) Date of Patent: Mar. 22, 2016

(54) 360° GYM

(76) Inventor: Sonny L. Carson, Flint, TX (US)

( * ) Notice: Subject to any disclaimer, the term of this patent is extended or adjusted under 35 U.S.C. 154(b) by 379 days.

(21) Appl. No.: 13/251,354

(22) Filed: Oct. 3, 2011

(65) Prior Publication Data

US 2012/0083395 A1 Apr. 5, 2012

Related U.S. Application Data

(60) Provisional application No. 61/389,329, filed on Oct. 4, 2010.

(51) Int. Cl.

| | |
|---|---|
| ***A63B 21/04*** | (2006.01) |
| ***A63B 21/055*** | (2006.01) |
| ***A63B 21/00*** | (2006.01) |

(52) U.S. Cl.

CPC ..... *A63B 21/0557* (2013.01); *A63B 21/00061* (2013.01); *A63B 21/00065* (2013.01); *A63B 21/00069* (2013.01); *A63B 21/0428* (2013.01); *A63B 21/0442* (2013.01); *A63B 21/154* (2013.01); *A63B 21/4043* (2015.10); *A63B 21/4049* (2015.10); *A63B 2208/0204* (2013.01); *A63B 2208/0242* (2013.01); *A63B 2210/50* (2013.01)

(58) Field of Classification Search

CPC ..... A63B 21/00061; A63B 21/00065; A63B 21/00069; A63B 21/0442; A63B 21/1496; A63B 21/154; A63B 21/156

USPC ..... 482/23, 38, 39, 121–126, 129, 137, 482/138, 904, 907

See application file for complete search history.

(56) References Cited

U.S. PATENT DOCUMENTS

| | | | | |
|---|---|---|---|---|
| 3,306,611 | A * | 2/1967 | Gaul | 482/103 |
| 4,506,884 | A * | 3/1985 | Hankin | 482/131 |
| 4,640,268 | A * | 2/1987 | Roberts | 601/24 |
| 4,709,918 | A * | 12/1987 | Grinblat | 482/70 |
| 5,024,433 | A * | 6/1991 | Mosberg | 482/96 |
| 5,102,122 | A * | 4/1992 | Piane et al. | 482/133 |
| 5,167,599 | A * | 12/1992 | Haller | 482/81 |
| 5,997,440 | A * | 12/1999 | Hanoun | 482/10 |
| 6,422,980 | B1 * | 7/2002 | Simonson | 482/99 |
| 6,592,498 | B1 * | 7/2003 | Trainor | 482/97 |
| 7,226,402 | B1 * | 6/2007 | Joya | 482/121 |
| 7,601,105 | B1 * | 10/2009 | Gipson et al. | 482/103 |
| 7,628,742 | B2 * | 12/2009 | Weaver | 482/125 |
| 8,096,926 | B1 * | 1/2012 | Batca | 482/99 |
| 8,246,524 | B2 * | 8/2012 | Castillo | 482/92 |
| 2004/0043873 | A1 * | 3/2004 | Wilkinson et al. | 482/54 |
| 2009/0170675 | A1 * | 7/2009 | Giannelli et al. | 482/139 |
| 2010/0016129 | A1 * | 1/2010 | Chou | 482/97 |

* cited by examiner

*Primary Examiner* — Loan H Thanh
*Assistant Examiner* — Gregory Winter
(74) *Attorney, Agent, or Firm* — Delphine James

(57) ABSTRACT

The exercise apparatus of the present invention includes a supporting frame of limited height to which the pulley-carrying system is rotationally connected. The pulley frame is releasably movable by the operator utilizing a swivel locking mechanism. By this locking mechanism, the operator releases a handle to cause the frame to rotate 360 degrees. The pulley frame contains multiple pulley units engaged with multiple bands. A handle mechanism allows the operator to selectively choose from the various bands which allows various levels of resistance and various exercises.

11 Claims, 11 Drawing Sheets

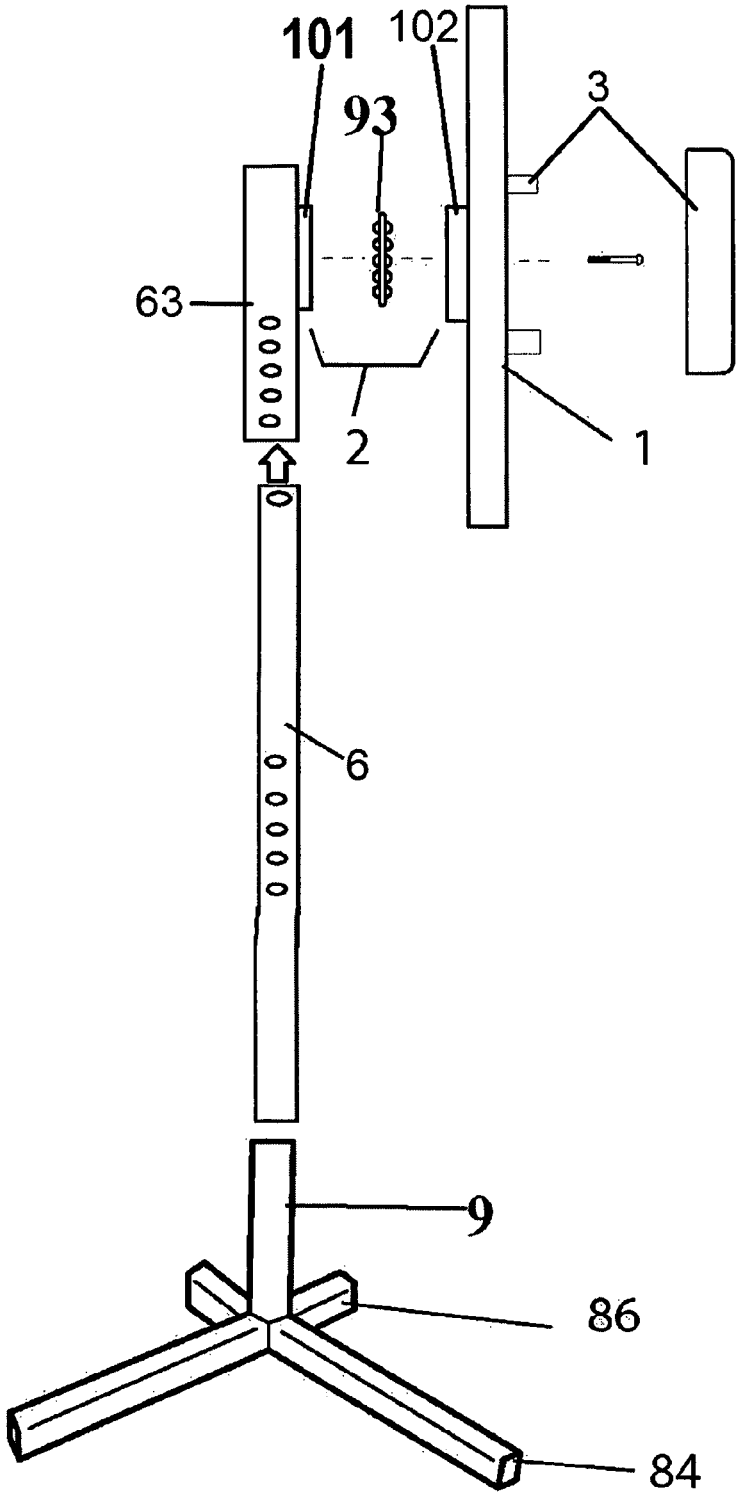
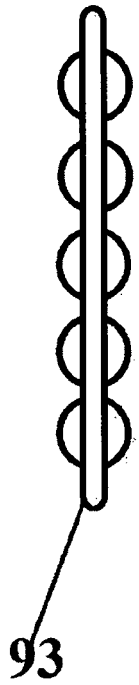
Figure 9b
Figure 9

360² GYM

This application claims the benefit of application provisional application 61/389,329.

BACKGROUND OF THE INVENTION

The present invention relates to an all-in-one exercise system for home use or in a fitness center. This exercise system provides a well-rounded resistance training program. It is able to allow the user to perform a variety of strength building and toning maneuvers. Elastic resistance bands provide the tension needed for the resistance training. Resistance training improves the strength, power, and endurances of muscles.

It helps boost the metabolism, and burn fat and calories. It improves muscle performance by increasing the size of muscle fibers which is called hypertrophy. Resistance training is an essential part of any exercise program. It is recommended that a person exercises for at least three thirty minutes workouts per week.

Normally, people purchase gym memberships because gyms provide a variety of exercise equipment. However, many people do not have the time required to travel to a gym often. Home gyms make exercise more accessible to people. In order to engage in effective resistance training, the person must use some type of weight. They can use their own body weight or free weights. The elastic bands work differently. By using either body weight or free weights, gravity provides the tension and where you feel resistance in the muscle. However, elastic bands provide constant tension.

SUMMARY OF THE INVENTION

It is an object of the invention to provide resistance training through the use of an improved resistance exercise apparatus that is highly versatile and easy-to-use. It is an object of the invention to provide an exercising machine that includes a pulley-carrying exercising apparatus that can be incrementally rotated in a complete 360 degree turn. This rotation ability allows numerous exercise positions to enable the proper performance of a number of different exercises.

Another object of the invention is to provide an apparatus of the aforementioned character in which the pulley-carrying exercise frame permits a full range of motion while using elastomeric cord-type resistance. The apparatus includes a compact, self-contained, resistance module which is easily assembled and disassembled.

Another object of the apparatus attaches the pulley-carrying system to a metal frame of limited length. The apparatus includes a supporting frame of limited height to which the pulley-carrying system is rotationally connected. The pulley frame is readily movable by the operator from a swivel locking mechanism. By this mechanism, the operator releases a handle to cause the frame to rotate.

Another object of the invention is the use of elastomeric resistance bands as the preferred method of resistance. The resistance bands can be tubular in nature and are run through the pulley units. The pulley frame contains multiple pulley units engaged with multiple bands. A body-engaging means can be in the form of a handlebar that is connected to each end of the bands, but other engaging means can be used. The operator is capable of moving the handlebars or other engaging means and selectively choosing form the various bands which allows various levels of resistance and various exercises.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 9 depicts a side view of the present invention.

FIG. 9*b* is a side cut away view of the ball bearings.

DETAILED DESCRIPTION OF INVENTION

Figure 2:
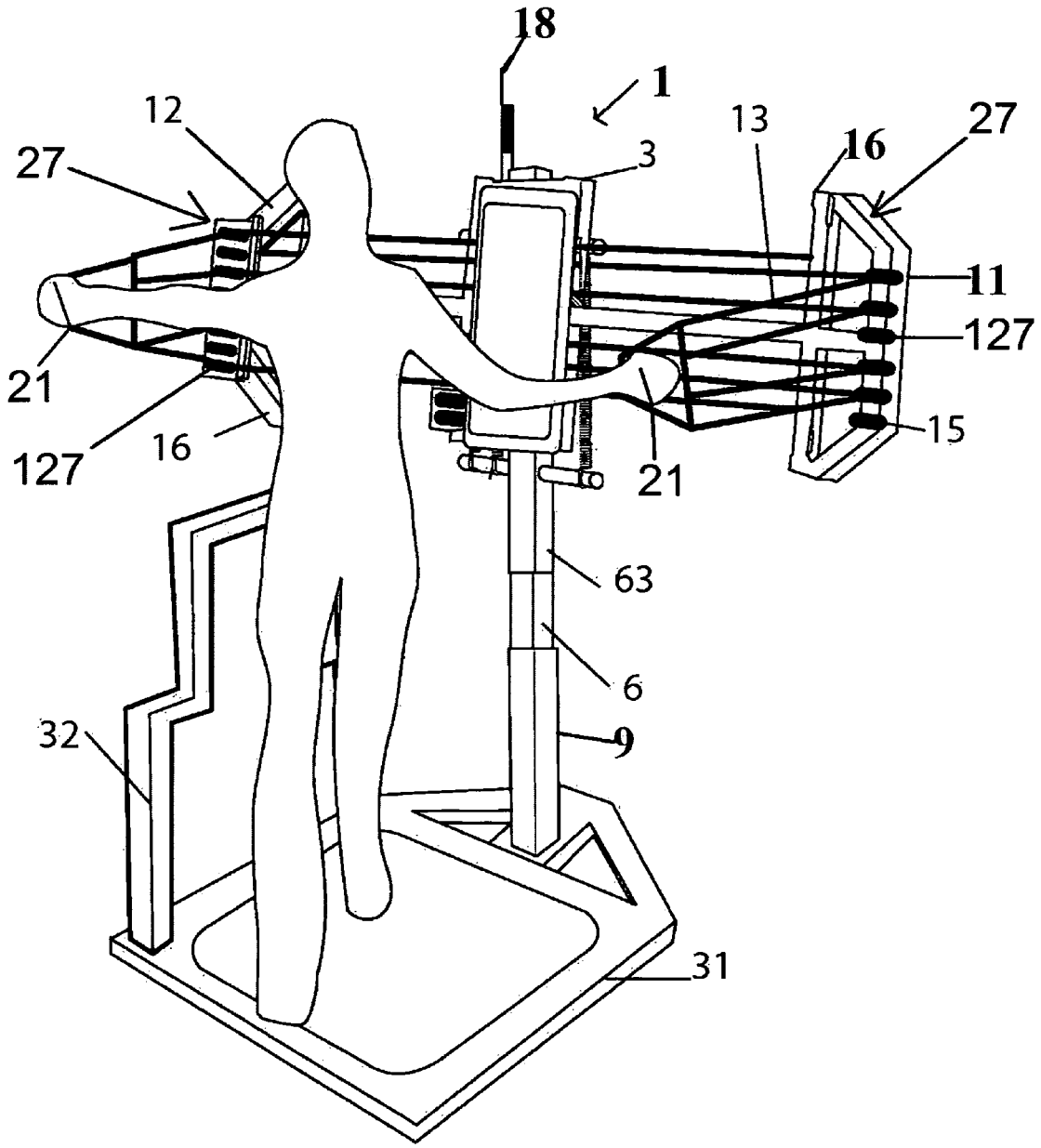
FIG. 2 depicts a frontal perspective view of the present invention with the platform embodiment.

Referring to FIG. 2, there is shown a perspective view of the exercise apparatus. In the preferred embodiment rotational main frame (1) is made of a sturdy, rigid metal such as steel with a height between 54" to 60" inches.

Figure 4:
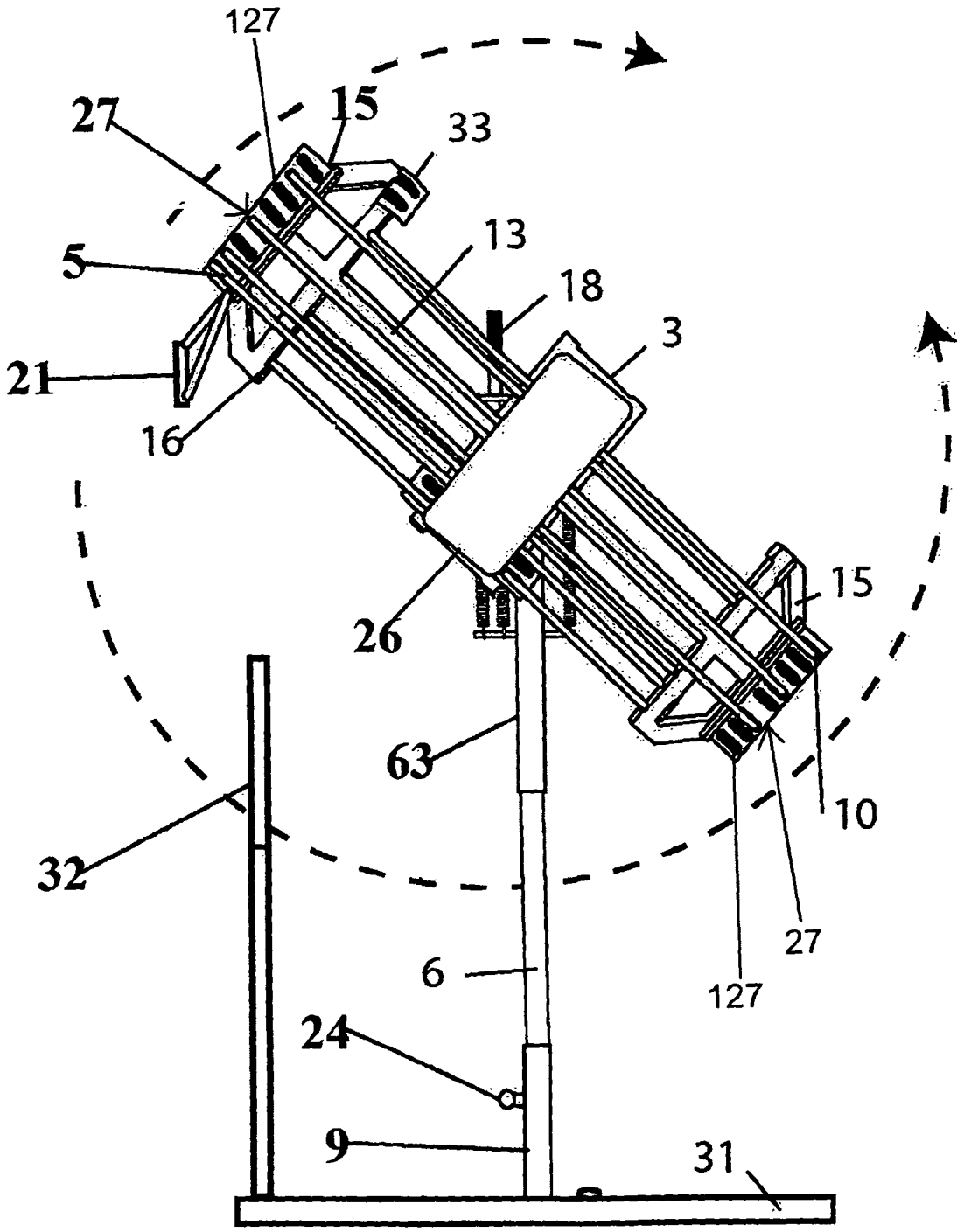
FIG. 4 illustrates a frontal perspective of the present invention with pulley system.
Figure 5:
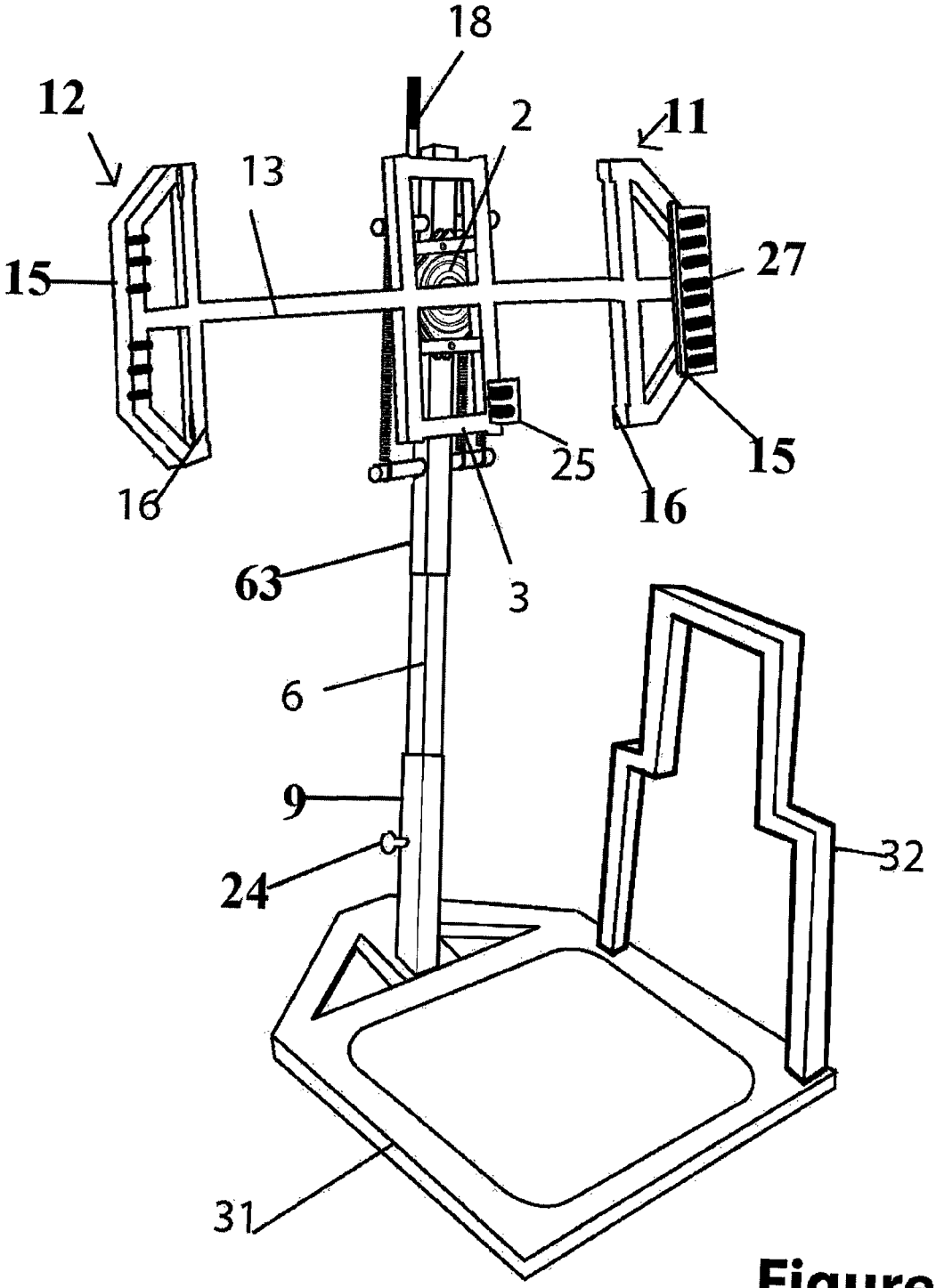
FIG. 5 illustrates an open perspective view of the present invention with platform embodiment.

Referring to FIG. 5, the body of the main rotational frame (1) consists of an elongated shaft (13) with pulley support frames (11, 12) fixably connected at each opposing end. A novel aspect of the present invention is the pulley system (10) illustrated in FIG. 4, connected to the main rotational frame (1). In the preferred embodiment, each pulley support frame (11, 12) has a 6 sided polygonal shape having an outer peripheral edge (15) and an inner peripheral edge (16).

As depicted in FIG. 5, disposed in the middle of elongated shaft (13) of rotational frame (1), is a connector frame (3) which allows the detachable swivel locking mechanism (2) to connect to the rotational frame (1). In the preferred embodiment, the connector frame (3) consists of four pipes that are welded together in the shape of a square. However, the configuration of connector frame (3) is not limited to a square shape.

Figure 1:
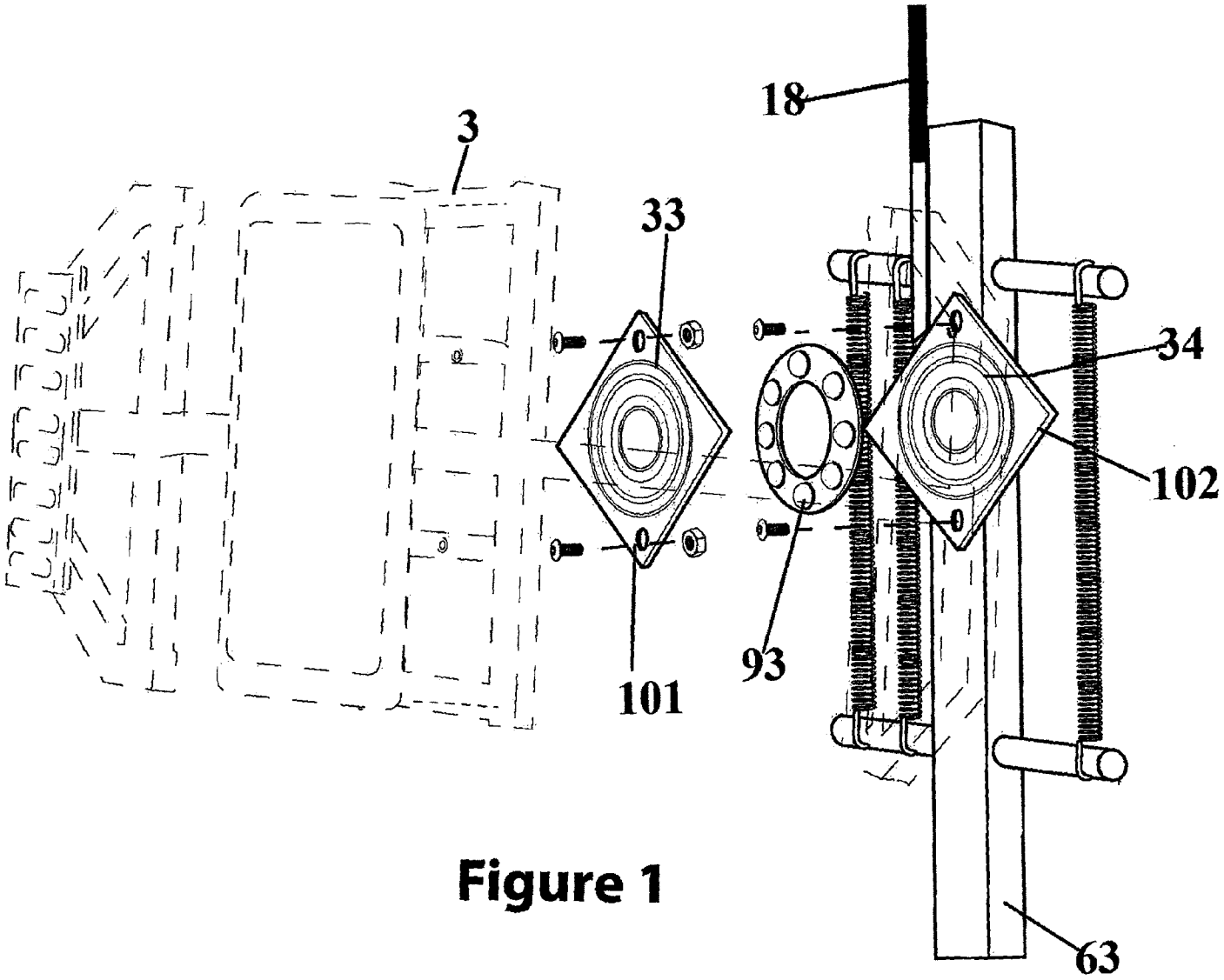
FIG. 1 depicts an exploded perspective view of the swivel locking mechanism

Referring to FIG. 1, the swivel mechanism (2) is rotationally connects by way of fasteners (30) connector frame (3) to shaft member (63). As depicted FIG. 1, swivel mechanism (2) is disposed between connector frame (3) and shaft member (63). When the connector frame (3) is connected to the rotational frame (1) the apparatus becomes an operational unit as shown in FIG. 2.

Figure 9A:
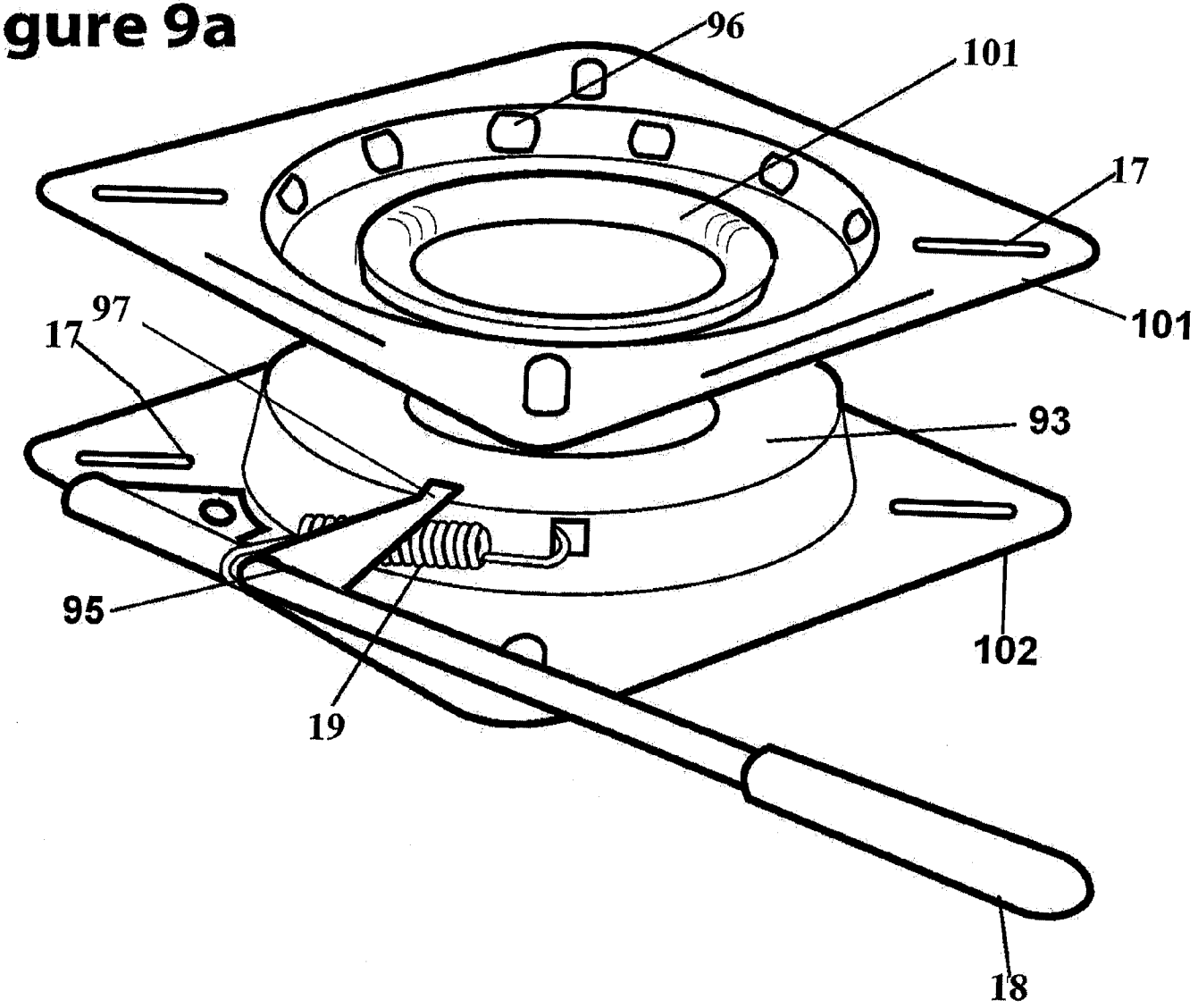
FIG. 9*a* is a cut away view swivel mechanism.

Forming an important aspect of the present invention is a selector means which functions to move the main frame in a 360° rotational motion. Through this selector, the rotational frame (1) rotates in a complete 360° turn incrementally into various positions. In the embodiment of the present invention, this selector takes the form of a swivel mechanism (2) which rotates when handle (18) releases the locking mechanism described below. Referring to FIGS. 9*a* and 9*b*, rotational mechanism (93) is used to create the rotational motion of the frame (1). In the preferred embodiment rotational mechanism (93) are ball bearings which are operationally disposed between upper plate member (101) and lower plate member (32). However, other suitable rotational mechanisms can be used within the present invention.

Referring to FIG. 9*a*, the swivel mechanism (2) allows the operator to rotate the frame (1) as well as locking it into the desired position. The swivel mechanism (2) consists of an upper plate member (101) and a lower plate member (102). In the preferred embodiment upper plate member (101) and lower plate member (102) are configured as square steel plates with upper channel members (33) and lower channel member (34) internally and circumferentially surrounding the central apex point of each plate member. Channel members (33, 34) are configured to receive a rotational locking mechanism (93) therebetween. Additionally, each plate member (101, 102) has four mounting slots (17), and they are arranged at each plate corner.

As shown in FIG. 9*a*, locking mechanism comprises handle (18), spring member (19), lever (95) and notches (96) circularly incorporated upon upper plate member (101). Release handle (18) is operationally attached to the swivel locking mechanism (2) by a metal spring member (19) as shown in FIG. 9A. A lever (95) is perpendicularly aligned at the distal end of handle (94) and extends outward to hook member (97) which is received within notches (96) located within the upper plate member (101). When the handle (94) is released from a locked position, the hook member (97) of the lever (95) is released from the notch (96) and rotational main frame (1) is able to rotate into a desired position.

Figure 3:
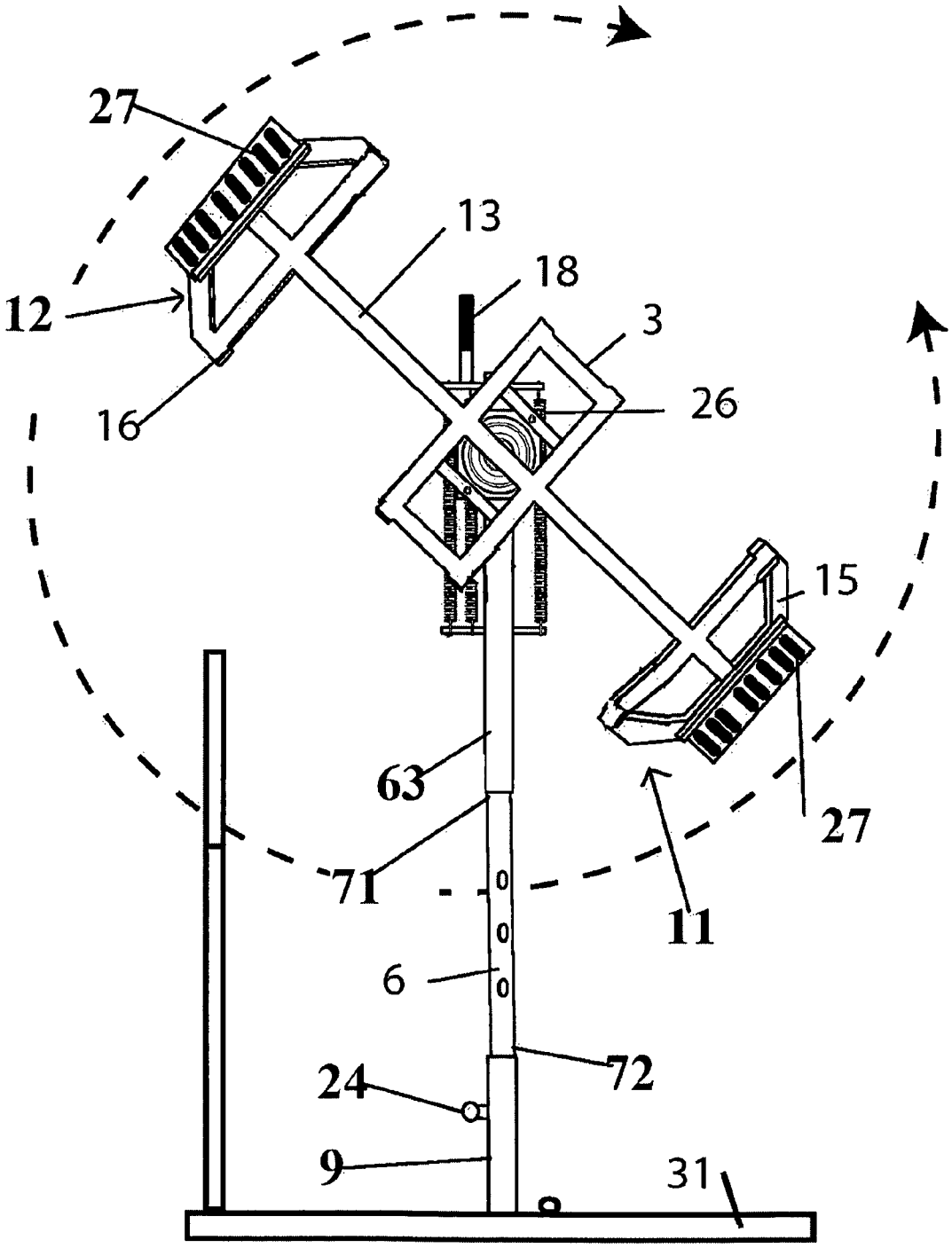
FIG. 3 illustrates a frontal perspective view of the present invention without the pulley system.

Referring to FIG. 3, mounted on each end of the rotational main frame (1) are adjacently disposed pulleys. As illustrated a plurality of pulley units (27) are mounted upon outer pulley frame (11, 12).

Figure 7:
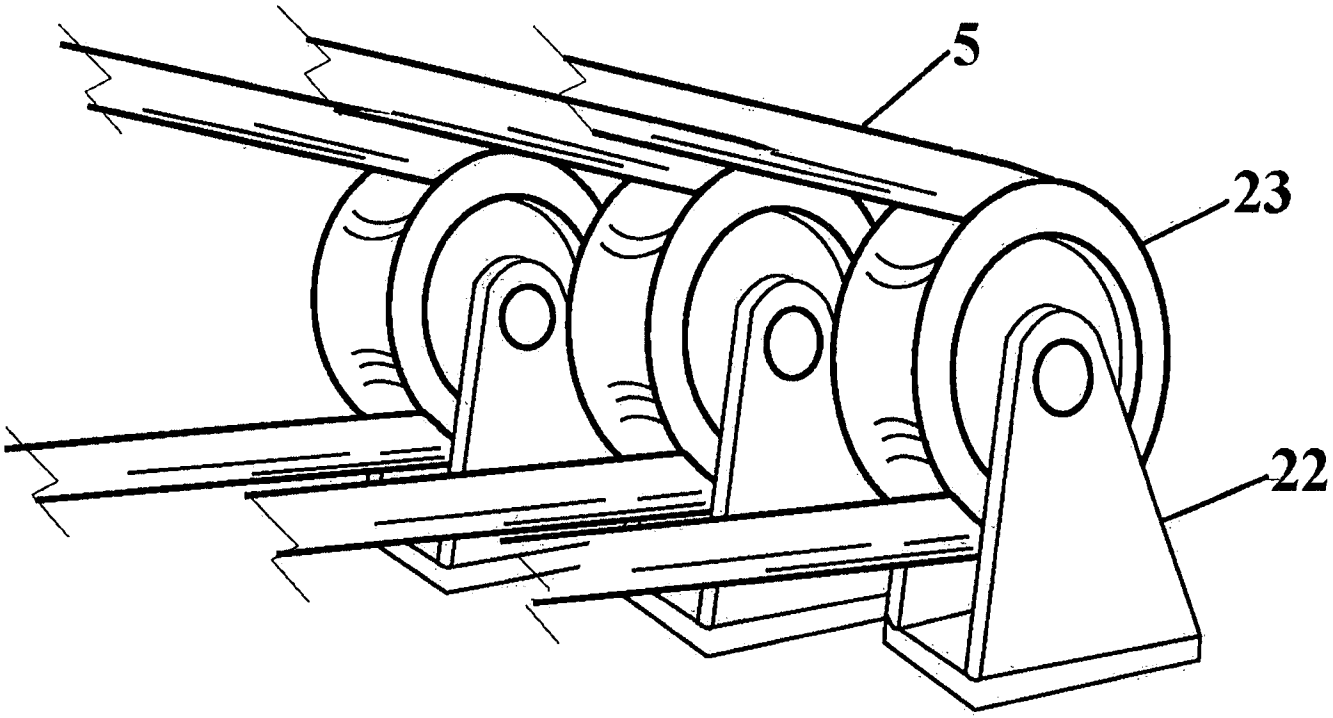
FIG. 7 depicts a cut away view of the pulley system

Referring to FIGS. 7 and 4, the pulley system (10) is illustrated where in a plurality of pulley units attached to the rotational main frame (1). In the preferred embodiment, a grouping of pulley units (27) is mounted to each outer peripheral edge (15) of pulley support frame (11, 12). FIG. 7 illustrates an exploded view of a groping of pulley units (27) with each pulley unit (127) which comprises a wheel member (23) rotationally mounted inter-disposed between support member (22). Elastic bands (5) are guided through each wheel member (23). Elastic bands (5) provides the tension necessary to support the exercises. Additionally, the tension of elastic bands (5) is adjustable to support the operator. The bands can be manually adjusted through tightened the bands or through another suitable mechanism can be utilized.

The resistance comprises a plurality of stretchable elastic bands (5) that are placed side-by-side as they are guided through pulley units of the pulley system (10). As shown in FIG. 3, the stretchable bands (5) are positioned over a pair of spaced-apart pulleys. In use, each band (5) can be passed through a pulley unit (127) located on opposing pulley support frames (11, 12). Connected to the ends of the bands (5) are gripping mechanisms or body-engaging means. In one embodiment the gripping mechanisms are handlebars (21) In alternative embodiments the body-engaging means can be a strap that encircles the body and attached to the bands (5). In use, the operator will be able to choose which bands (5) the handlebars (21) are attached to. Handlebars (21) can be removably attached to an end of selected bands (5).

Referring to FIGS. 3 and 4, vertical stand (6) comprises an elongated shaft extending vertically upward to an upper end (71) and a lower end (72). Elongated shaft (63) is configured to allow the operator to adjust height. Upper end (71) is configured to removably engage with opened end of shaft member (63) of rotational main frame (1) while lower end (72) is configured to removably engage with upper end of tubular portion of stabilizing base (9). Additionally, back support member (26) can be removably or fixably mounted upon the front side of the central frame portion of the rotational spin frame. As shown the back support member is rectangular in shape and is configured to seat upon the central frame portion.

Figure 10:
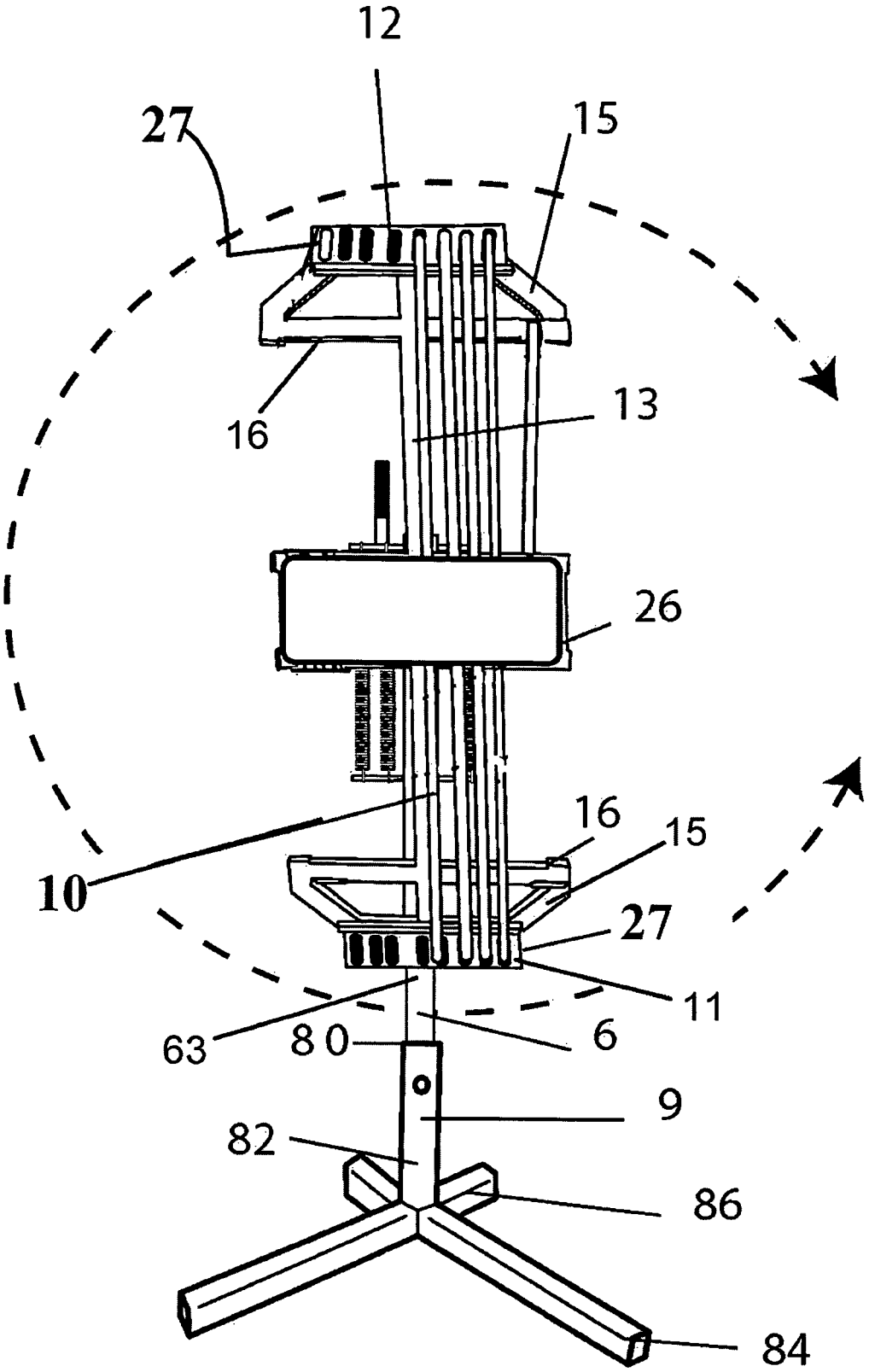
FIG. 10 illustrates a front view an alternative embodiment of the present invention.

FIG. 10 shows an alternative embodiment of the base member (9). the remaining components of the exercise apparatus functions substantially equivalent Referring to FIGS. 10 and 9B, stabilizing base portion (9) comprises a hollow tubular elongated portion (82) extending vertically upward to an opened top end (80). Extending at an angle tapering outwardly from the bottom portion (83) of tubular portion are tapering front legs (84) and back leg (86) providing support to the exercise apparatus on a flat planar surface area allowing the exercise apparatus to stand upright. In the preferred embodiment, the two front legs (84) are longer than the two back legs (86). Attached at the back of the base portion is a smaller hollow tubular portion that extends vertically upward. Several round weights are slid onto this portion and provide stability to the base (9). As stated, the base (9) has a hollow tubular portion which is open at the top which allows the vertical stand (6) to slidably engage with the base portion (9).

The base portion (9) utilizes a locking means in order to maintain the desired height above ground. This locking means takes the form of a push pin (24). The operator places the push pin (24) into one of three apertures disposed in the top end (80) of tubular portion of base portion (9). The base (9) has three apertures drilled in a vertical linear setting which are capable of aligning with the apertures located at the bottom end (72) of the vertical stand (6). Three apertures are drilled into the walls of the elongated tubular portion (82) and the vertical stand (6) with one hole located on each wall. This allows for the stand to be adjusted on both ends of vertical stand (6).

Figure 6:
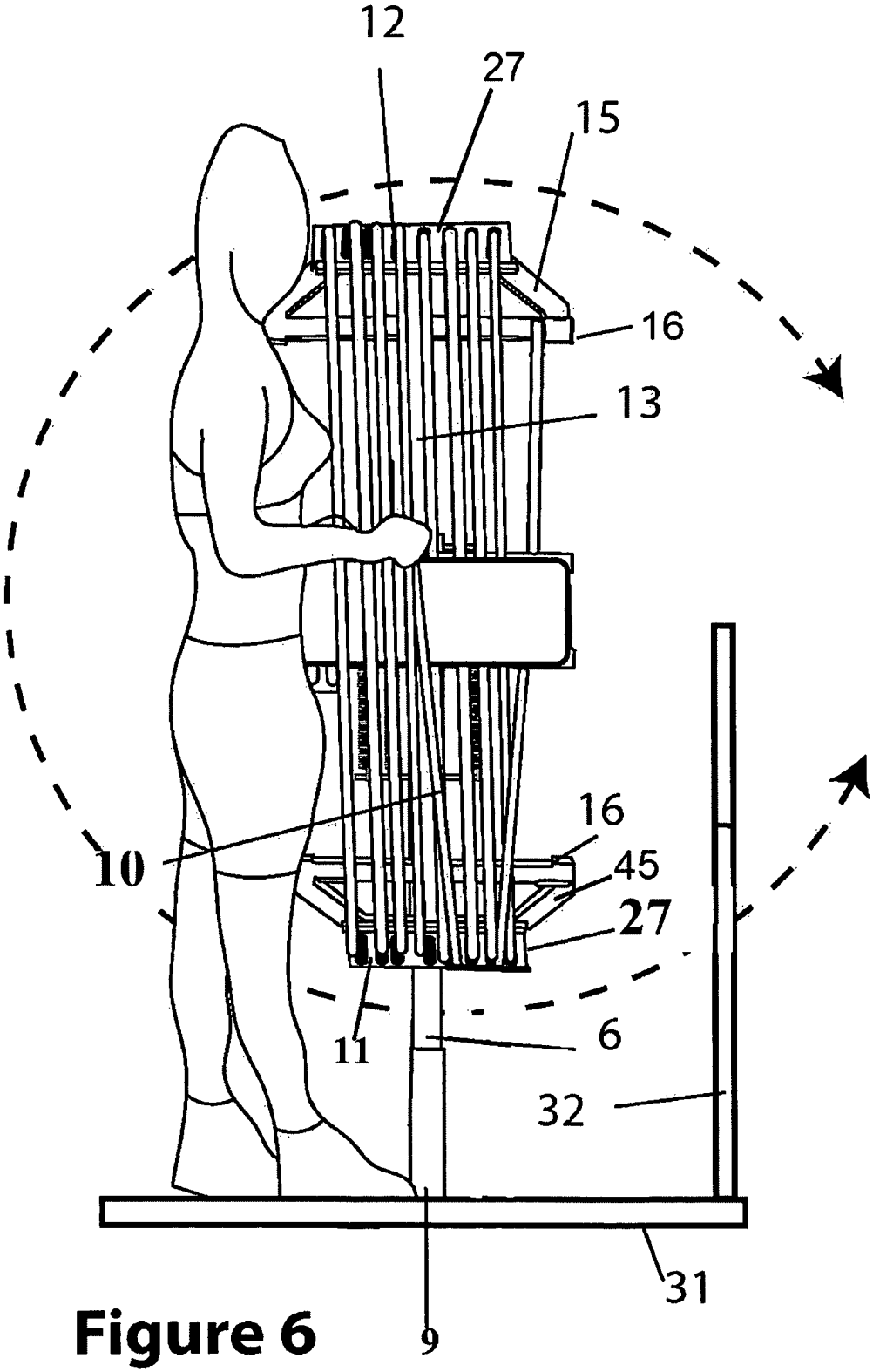
FIG. 6 depicts a side view of the present invention with the platform embodiment.

Referring to FIGS. 2, 5, and 6, an alternative embodiment of the present invention is illustrated. The base of the vertical stand (6) is perpendicularly connected to a platform (31). In the illustrated embodiment, the platform (31) is rectangular in structure and consists of a flat, planar surface that is aligned parallel to the ground surface. In use platform (31) allows the user to stand in an upright position. The handrail (32) consists of a plurality of rectangular pipes that are connected on both ends. The handrail (32) is perpendicularly attached on outer side edge of the platform (31). In use, the handrail (32) supports a person while they are exercising on the platform (31).

Figure 8:
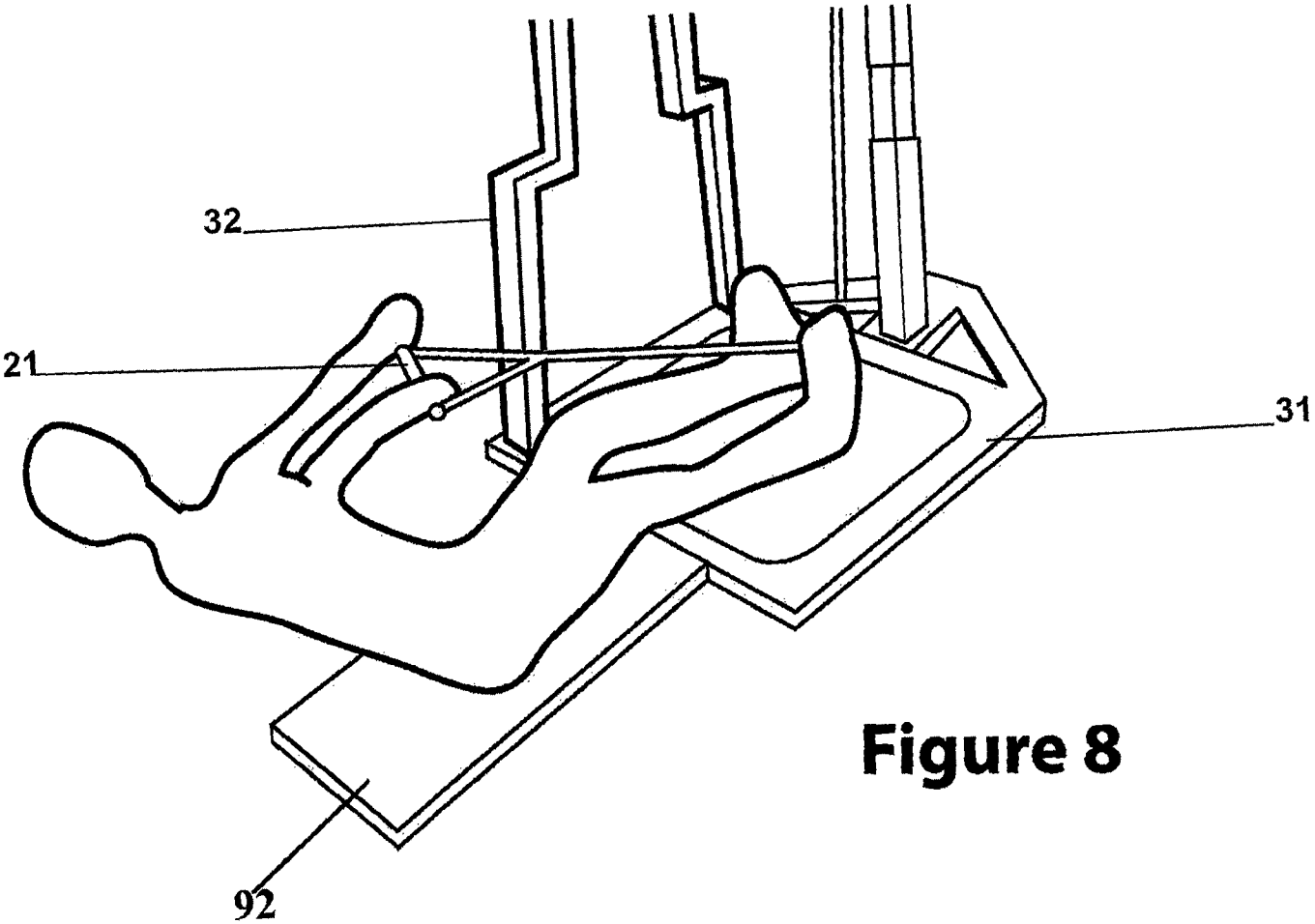
FIG. 8 is a view of the back extension pad

Referring to FIG. 8, a cushion (92) is attached to one side edge of platform (31) in a parallel arrangement with the ground surface. The cushion (92) allows the user to rest their upper body on the ground while performing abdominal exercises. The body engaging member (21) can be a hand gripping member, a band that is encompasses the body to the flexible band member while a user is exercising on the platform member, or another suitable body engaging mechanism.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

What is claimed is:

1. An exercising apparatus for use by a person in the performance of exercises, the apparatus comprising:

a base member for supporting the exercise apparatus in an upright position above a ground surface or a flat surface;

a vertical stand defined by a top end and a lower end;

the lower end of the vertical stand being aligned vertically above the base member and mounted upon an outer perimeter of the base member;

an extension shaft member defined by a top end and a lower end;

a unitary elongated body spin frame defined by an integrally formed center frame portion with opposing side frame members;

a plurality of pulley members mounted to a first side frame and a second side frame member, wherein the first side frame member and the second side frame member are diametrically opposed and the plurality of pulley members mounted to the first side frame member are in a vertically aligned arrangement and the plurality of pulley members mounted to the second frame member are in a vertically aligned arrangement;

a resistance assembly comprising a plurality of flexible band members operationally configured to a desired tension level with a first end diametrically opposed to a second end;

the first end of each flexible band member operationally connected to the first side frame member;

the second end of each flexible band member operationally connected to the second side frame member;

the upper end of the extension shaft member being mounted to a lower end of a frame shaft member attached to the center frame portion of the spin frame and extending linearly downward therefrom;

the lower end of the extension shaft member being removably coupled to the top end of the vertical stand;

the extension shaft member disposed between the spin frame and the vertical stand;

wherein the diametrically opposed ends of each of the flexible band members are mounted to and operationally engaged with a pair of diametrically opposed pulley members on the opposing side frame members a body engaging member operationally coupled to the resistance assembly wherein a user can perform exercises upon the base member;

a locking mechanism rotatably mounted to a back side of the center frame portion of the spin frame such that when the locking mechanism is released the unitary body of the spin frame can rotate 360 degrees along the vertical axis to another desired position.

2. The apparatus of claim 1 wherein the base member further comprises:

a plurality of leg members circumferentially attached to the lower end of the vertical stand and extended outwardly therefrom.

3. The exercise apparatus of claim 1 wherein the locking mechanism further comprises:

a body defined by a female plate member rotationally mounted to a male plate member;

the female plate member removably mounted to a backside of the central frame portion;

a handle operationally coupled and cooperatively engaged with the body wherein the spin frame can be rotated 360 degrees to a desired position when the handle is released from a lock position.

4. The exercise apparatus of claim 1 wherein the vertical stand has a telescopic portion that is adjustable in length.

5. The exercise apparatus of claim 1 wherein the extension shaft member stand assembly has a telescopic portion that is adjustable in length.

6. The exercise apparatus of claim 1 wherein the spin frame further comprises a back support member removably attached to a front side of the central frame portion of the spin frame.

7. The exercise apparatus of claim 1 wherein the body engaging member comprises a removable hand-gripping mechanism that is removably attached to a pulley member.

8. The exercise apparatus of claim 1 wherein the body engaging member is a flexible strap that encircles a user's body and is removably attached to the resistance assembly.

9. The exercise apparatus of claim 1 wherein the base member further comprises a platform with a flat top surface aligned parallel to the ground surface or the flat surface and is removably attached to the lower end of the vertical stand.

10. The exercise apparatus of claim 9 wherein the base member further comprises:

a hand rail structure removably attached to and perpendicularly aligned upon an outer edge of the platform and extending linearly upward therefrom.

11. The exercise apparatus of claim 1 wherein the resistance assembly further comprises:

a first and an opposing second outer pulley support frame attached to the opposing side frame members of the spin frame;

a plurality of pulley units mounted to the first and the second outer pulley support frame.

* * * * *